US008203525B2

(12) United States Patent
Lin et al.

(10) Patent No.: US 8,203,525 B2
(45) Date of Patent: Jun. 19, 2012

(54) DUAL-LAMP DRIVING CIRCUIT FOR LIQUID CRYSTAL DISPLAYS

(75) Inventors: Cheng-Ta Lin, Jhongli (TW); Tsung-Liang Hung, Jhongli (TW); Yi-Hsun Lin, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 355 days.

(21) Appl. No.: 12/603,657

(22) Filed: Oct. 22, 2009

(65) Prior Publication Data

US 2010/0182347 A1 Jul. 22, 2010

(30) Foreign Application Priority Data

Jan. 16, 2009 (CN) ..... 2009 1 0105115

(51) Int. Cl.
*G09G 3/36* (2006.01)

(52) U.S. Cl. ..... 345/102

(58) Field of Classification Search ..... 345/102; 349/61–70; 362/561
See application file for complete search history.

(56) References Cited

U.S. PATENT DOCUMENTS

2003/0178951 A1* 9/2003 Park et al. ..... 315/312
2005/0083282 A1* 4/2005 Honbo ..... 345/87
2006/0187181 A1* 8/2006 Kim ..... 345/102
2009/0237346 A1* 9/2009 Bai et al. ..... 345/102

* cited by examiner

*Primary Examiner* — Chanh Nguyen
*Assistant Examiner* — Ram Mistry
(74) *Attorney, Agent, or Firm* — Altis Law Group, Inc.

(57) ABSTRACT

A dual-lamp driving circuit includes a first frequency switch control circuit, a second frequency switch control circuit, a pulse-width modulation (PWM) control circuit, a first power stage circuit, a second power stage circuit, a conversion circuit, and a feedback circuit. The first frequency switch control circuit receives a first enable signal, and outputs a first frequency switch signal according to the first enable signal. The second frequency switch control circuit receives a second enable signal, and outputs a second frequency switch signal according to the second enable signal. The PWM control circuit outputs various PWM control signals according to the first frequency switch signal and the second frequency switch signal. The feedback circuit feeds back a first current signal from the first lamp to the frequency switch control circuit, and a second current signal from the second lamp to the frequency switch control circuit.

16 Claims, 4 Drawing Sheets

DUAL-LAMP DRIVING CIRCUIT FOR LIQUID CRYSTAL DISPLAYS

BACKGROUND

1. Technical Field

The disclosure relates to lamp circuits, and particularly to a dual-lamp driving circuit configured in liquid crystal displays (LCD).

2. Description of Related Art

In small-sized liquid crystal display (LCD) devices, generally only two discharge lamps are employed to meet brightness requirements. The two discharge lamps are driven by an inversion circuit which generates and transmits alternating current (AC) signals able to drive the two discharge lamps.

In the inversion circuit, a pulse-width modulation (PWM) controller, or two PWM controllers combined in a synchronous circuit commonly control the two discharge lamps synchronously. That is, the two discharge lamps are turned on or off synchronously, which results in limited brightness adjustment and low power efficiency of the LCD.

Therefore, a need exists in the industry to overcome the described limitations.

DETAILED DESCRIPTION

Figure 1:
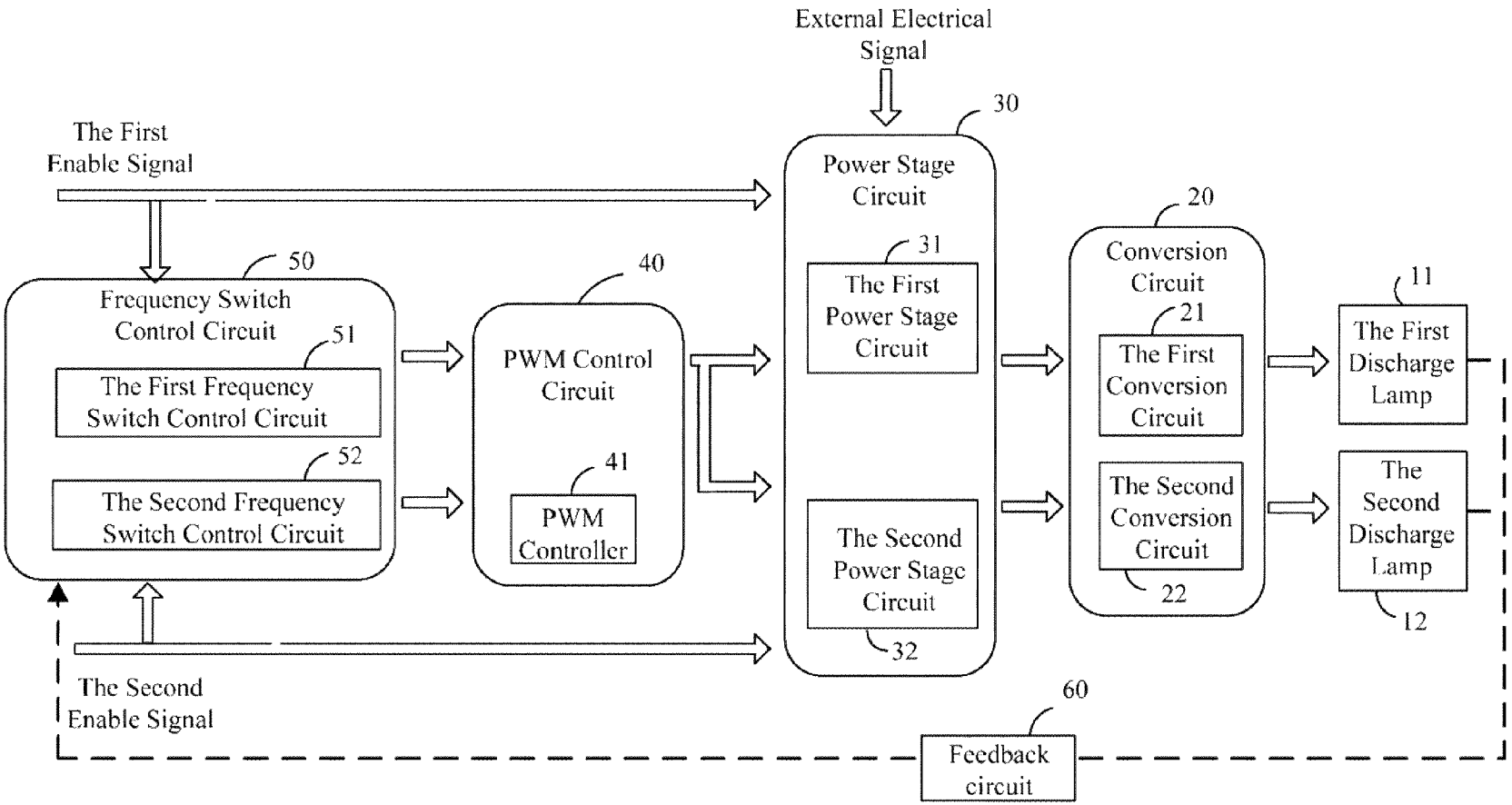
FIG. 1 is a block diagram of one embodiment of a dual-lamp driving circuit of the disclosure.

FIG. 1 is a block diagram of one embodiment of a dual-lamp driving circuit of the disclosure. The dual-lamp driving circuit configured in a liquid circuit display (LCD) device is operable to drive a first discharge lamp 11 and a second discharge lamp 12. The dual-lamp driving circuit comprises a conversion circuit 20, a power stage circuit 30, a pulse-width modulation (PWM) control circuit 40, a frequency switch control circuit 50, and a feedback circuit 60. The power stage circuit 30 receives and converts an external electrical signal into square wave signals. The conversion circuit 20 converts the square wave signals into sine wave signals able to drive the first discharge lamp 11 and the second discharge lamp 12. The PWM control circuit 40 and the frequency switch control circuit 50 work together to direct the power stage circuit 30 to output the square wave signals in different frequencies, so as to light the first discharge lamp 11 and the second discharge lamp 12 asynchronously.

The frequency switch control circuit 50 receives a first enable signal and/or a second enable signal, and correspondingly outputs a first frequency switch signal and a second frequency switch signal. The first enable signal and the second enable signal are asynchronous signals.

In the illustrated embodiment, the frequency switch control circuit 50 comprises a first frequency switch control circuit 51 and a second frequency switch control circuit 52. The first frequency switch control circuit 51 receives the first enable signal, and outputs the first frequency switch signal based on the first enable signal. Similarly, the second frequency switch control circuit 52 receives the second enable signal, and outputs the second frequency switch signal based on the second enable signal.

The PWM control circuit 40 is connected to the first frequency switch control circuit 51 and the second frequency switch control circuit 52, and outputs various PWM control signals based on one or both of the first frequency switch signal and the second frequency switch signal.

In the illustrated embodiment, the PWM control circuit 40 comprises a PWM controller 41 configured to generate the PWM control signals.

The power stage circuit 30 comprises a first power stage circuit 31 and a second power stage circuit 32. In the illustrated embodiment, the first power stage circuit 31 is connected to the PWM control circuit 40, and converts the received external electrical signal into a first square wave signal.

In other exemplary embodiments, the first power stage circuit 31 is configured to receive the PWM control signal from the PWM control circuit 40 under the direction of the first enable signal, and to receive and convert the external electrical signal to the first square-wave signal based on the received PWM control signal. That is, if the first power stage circuit 31 receives the first enable signal, the first power stage circuit 31 receives the PWM control signal to output the first square wave signal. Accordingly, the first power stage circuit 31 outputs no first square wave signal if no PWM control signals are received. In the illustrated embodiment, the first enable signal is a continuous signal.

The second power stage circuit 32 is connected to the PWM control circuit 40, and converts the received external electrical signal into a second square wave signal based on the PWM control signal from the PWM control circuit 40. In the illustrated embodiment, the second power stage circuit 32 receives the PWM control signal under the direction of the second enable signal, and receives and converts the external electrical signal to the second square-wave signal based on the received PWM control signal. If the second power stage circuit 32 receives the second enable signal, the second power stage circuit 32 receives the PWM control signal to output the second square wave signal. Accordingly, the second power stage circuit 32 outputs no second square wave signal if no PWM control signal is received. In the illustrated embodiment, the second enable signal is a continuous signal.

The conversion circuit 20 comprises a first conversion circuit 21 and a second conversion circuit 22. The first conversion circuit 21 is connected between the first power stage circuit 31 and the first discharge lamp 11, and converts the first square wave signal to the first sine wave signal able to drive the first discharge lamp 11. The second conversion circuit 22 is connected between the second power stage circuit 32 and the second discharge lamp 12, and converts the second square wave signal to the second sine wave signal able to drive the second discharge lamp 12.

The feedback circuit 60 is disposed between the first and second discharge lamps 11, 12 and the frequency switch control circuit 50. The feedback circuit 60 feeds back a first current signal through the first discharge lamp 11 and a second current signal through the second discharge lamp 12 to the first frequency switch control circuit 51 and the second frequency switch control circuit 52, respectively, so as to control the output of the first frequency switch control circuit 51 and the second frequency switch control circuit 52.

Figure 2:
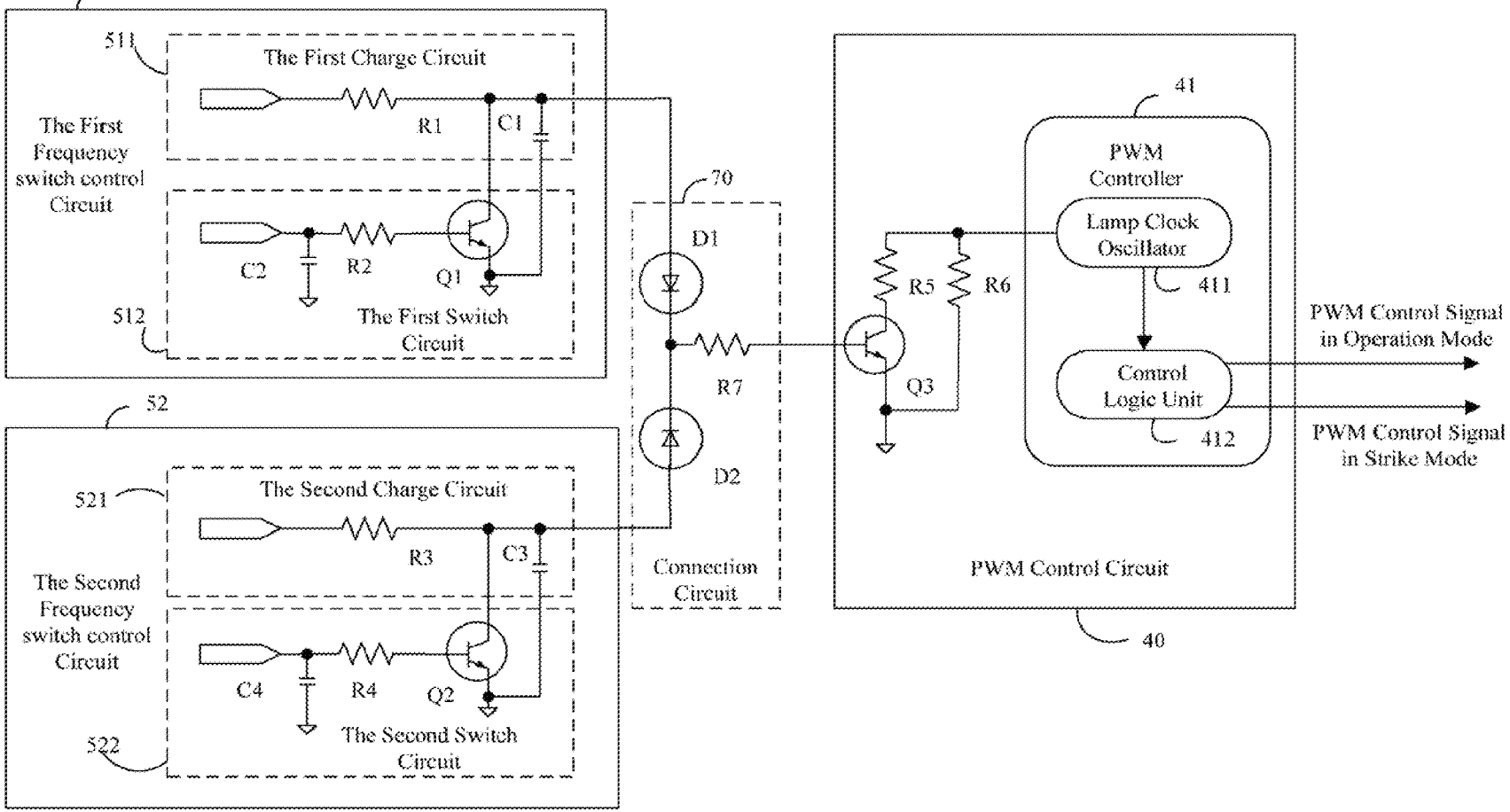
FIG. 2 is a detailed circuit diagram of one embodiment of a frequency switch control circuit and a PWM control circuit illustrated in FIG. 1.

FIG. 2 is a detailed circuit diagram of one embodiment of the frequency switch control circuit 50 and the PWM control circuit 40. In the illustrated embodiment, the first frequency switch control circuit 51 comprises a first charge circuit 511 and a first switch circuit 512. The first charge circuit 511 receives the first enable signal, and outputs the first frequency switch signal based on the first enable signal. The first switch circuit 512 receives the first current signal through the first discharge lamp 11, and stops the output of the first switch circuit 511 upon receipt of the first current signal.

In the illustrated embodiment, the first charge circuit 511 comprises a first resistor R1 and a first capacitor C1. One end of the first resistor R1 receives the first enable signal. One end of the first capacitor C1 is connected to the other end of the first resistor R1, and the other end is connected to ground. When the first charge circuit 511 receives the first enable signal, the first capacitor C1 is charged and the first frequency switch signal is output from the other end of the first resistor.

The first switch circuit 512 comprises a second resistor R2 and a first transistor Q1. One end of the second resistor R2 receives the second enable signal. In the illustrated embodiment, the base of the first transistor Q1 is connected to the other end of the second resistor R2, the collector is connected to the other end of the first resistor R1, and the emitter is connected to ground. When the first switch circuit 512 receives the first current signal by way of the second resistor R2, a voltage on the base of the first transistor Q1 rises so as to turn on the first transistor Q1, grounding output of the first charge circuit 511 via the first transistor Q1. In this condition, the first charge circuit 511 stops the first frequency switch signal to the PWM control circuit 40.

In the illustrated embodiment, the first switch circuit 512 further comprises a second capacitor C2 with one end connected to the one end of the second resistor R2, and the other end connected to ground. The second capacitor C2 is configured to filter the first current signal.

The second frequency switch control circuit 52 comprises a second charge circuit 521 and a second switch circuit 522. The second charge circuit 521 receives the second enable signal, and outputs the second frequency switch signal based on the second enable signal. The second switch circuit 522 receives the second current signal through the second discharge lamp 11, and stops the output of the second switch circuit 521 upon receipt of the second current signal.

In the illustrated embodiment, the second charge circuit 521 comprises a third resistor R3 and a third capacitor C3. One end of the third capacitor C3 is connected to the other end of the third resistor R3, and the other end is connected to ground. The third resistor R3 and the third capacitor C3 are configured and structured to wait a predetermined duration upon receipt of the second enable signal so as to delay generating the second frequency switch signal. If the second charge circuit 521 over waits and the second switch circuit 522 fails to receive the second current signal from the feedback circuit, the second frequency switch control circuit 52 generates and transmits the second frequency switch signal to the PWM control circuit 40.

The second switch circuit 522 comprises a fourth resistor R4 configured for current limiting and a second transistor Q2. One end of the fourth resistor R4 receives the second current signal from the feedback circuit 60. The base of the second transistor Q2 is connected to the other end of the fourth resistor R4, the collector is connected to the other end of the third resistor R3, and the emitter is connected to ground. A voltage on the base of the second transistor Q2 rises to so as to turn on the second transistor Q2 when the second switch circuit 522 receives the second current signal by way of the fourth resistor R4, so that the output of the second charge circuit 521 is connected to ground via the second transistor Q2, and the second charge circuit 521 stops the second frequency switch signal to the PWM control circuit 40.

Alternatively, the second switch circuit 522 can further comprise a fourth capacitor C4 configured to filter the second current signal, where one end of the fourth capacitor C4 is connected to one end of the fourth resistor R4, and the other end is grounded.

The PWM control circuit 40 further comprises a parallel circuit comprising of a fifth resistor R5 and a sixth resistor R6 connected in parallel, where one end of the parallel circuit is connected to the PWM controller 41, and the other end is grounded. A third transistor Q3 is connected to the fifth resistor R5 in series, where the base of the third transistor Q3 receives the alternative one of the first frequency switch signal and the second frequency switch signal, and the collector and the emitter are respectively connected to the fifth resistor R5 and the ground. When the base of the third transistor Q3 receives neither the first frequency switch signal and nor the second frequency switch signal, the third transistor Q3 turns off and the fifth resistor R5 is suspended, so that the impedance of the parallel circuit equals that of the sixth resistor R6. Conversely, when the base of the third transistor Q3 receives alternative one of the first frequency switch signal and the second frequency switch signal, the third transistor Q3 turns on, and the fifth resistor R5 is coupled to the sixth resistor R6, so that the impedance of the parallel circuit is decreased consequently.

In the illustrated embodiment, the current through the PWM controller 41 is determined by the impedance of the PWM control circuit 40. That is, an increase in the impedance of the PWM control circuit 40 lowers current through the PWM controller 41 and frequency output therefrom.

Alternatively, the PWM controller 41, generating the PWM control signal, comprises a lamp clock oscillator 411 and a control logic unit 412. The lamp clock oscillator 411 outputs various frequencies based on the different impedances of the parallel circuit. In the illustrated embodiment, if the current through the third transistor Q3 is sufficient to turn on the third transistor Q3, the frequency generated by the lamp clock oscillator 411 is high, and the alternative one of the first discharge lamp 11 and the second discharge lamp 12 operates in strike mode under which the alternative one of the first discharge lamp 11 and the second discharge lamp 12 is lighted by a first voltage signal. Conversely, if the current through the third transistor Q3 is insufficient to turn on the transistor Q3, the frequency generated by the lamp clock oscillator 411 is low, the first discharge lamp 11 and the second discharge lamp 12 operate in operation mode under which the first discharge lamp 11 and the second discharge lamp 12 are driven by a second voltage signal with the frequency lower than that of the first voltage signal. In this embodiment, the frequency of the first voltage signal is 70 HZ, and frequency of the second voltage signal is 50 HZ. The control logic unit 412 outputs the PWM control signal to the power stage circuit 30 based on the various frequencies from the lamp clock oscillator 411.

Alternatively, the dual-lamp driving circuit can further comprise a connection circuit 70 connected between the frequency switch control circuit 50 and the PWM control circuit 40, transmitting one or both of the first frequency switch signal and the second frequency switch signal to the PWM control circuit 40 via the base of the transistor Q3, avoiding interference between the first frequency switch signal and the second frequency switch signal.

The connection circuit 70 comprises a first diode D1, a second diode D2 and the seventh resistor R7. The anode of the first diode D1 is connected to the first frequency switch control circuit 51, and the anode of the second diode D2 is connected to the second frequency switch control circuit 52. The cathodes of the first diode D1 and the second diode D2 are connected together. One end of the seventh resistor R7 is connected to the cathodes of both the first diode D1 and the second diode D2, and the other end is connected to the PWM control circuit 40. The seventh resistor R7 converts current signals to voltage signals. The first diode D1 and the second diode D2 are configured to avoid interference between the first frequency switch control circuit 51 and the second frequency switch control circuit 52.

In other exemplary embodiments, the quantity and values of the resistors may be varied according to practical requirement, and are not limited to the embodiments of the disclosure.

Figure 3:
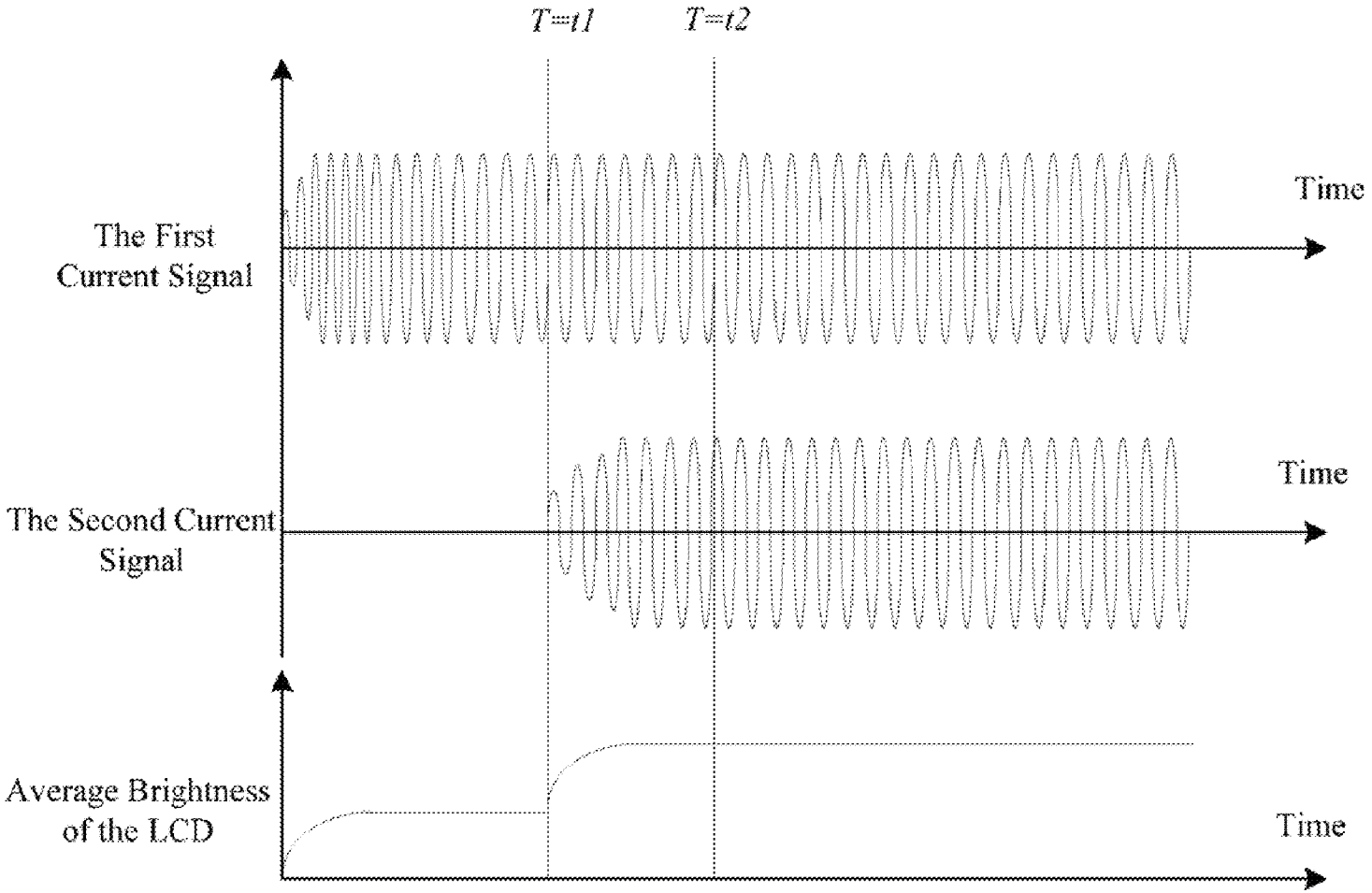
FIG. 3 is a schematic diagram of change trends of a first current signal, a second current signal, and an average brightness of a liquid circuit display (LCD) configured with the dual-lamp driving circuit of the disclosure; in which the dual-lamp driving circuit drives a second discharge lamp in an operation mode.
Figure 4:
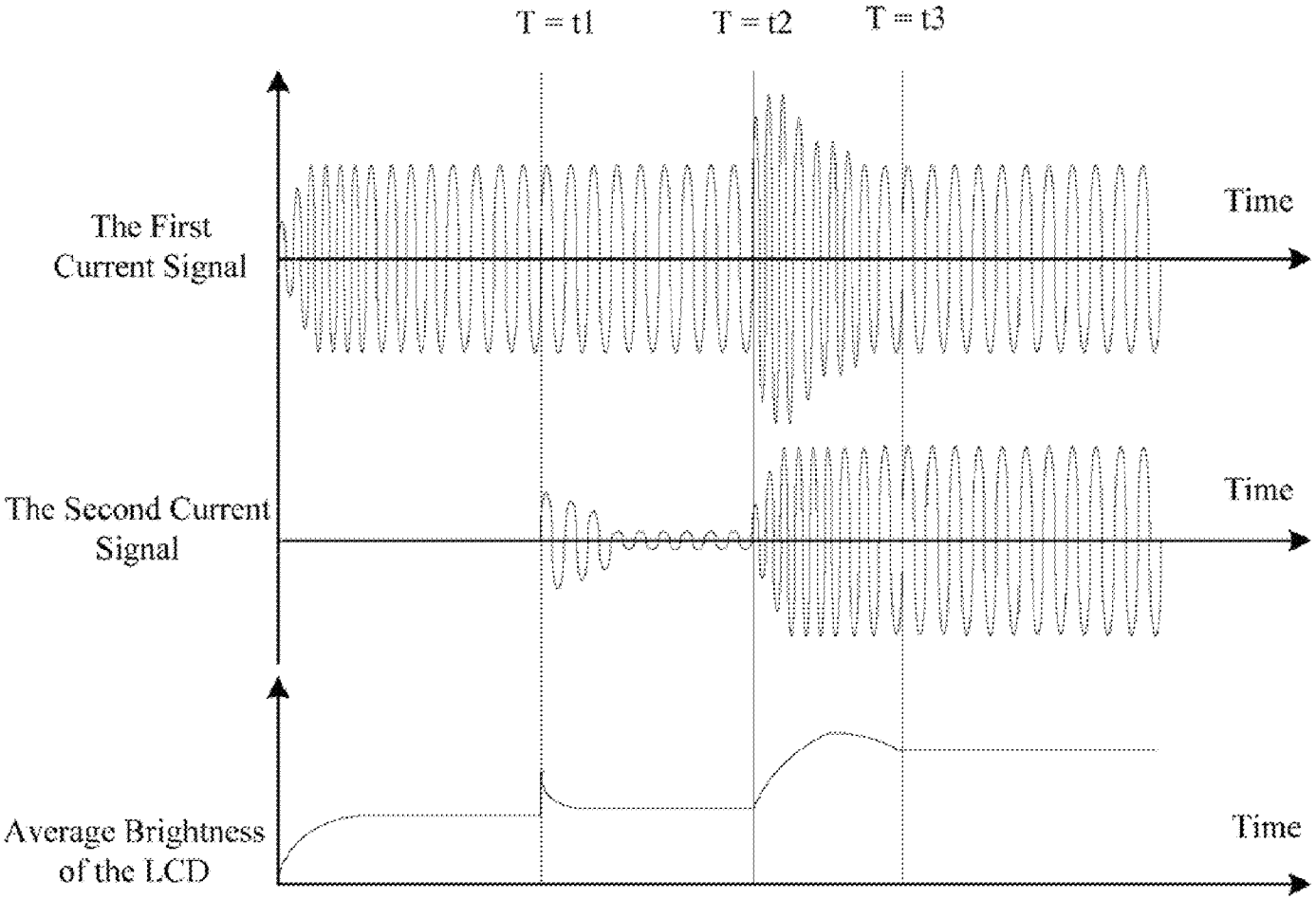
FIG. 4 is a schematic diagram of the change trends of the first current signal, the second current signal, and the average brightness of the LCD, in which the dual-lamp driving circuit drives the second discharge lamp in a strike mode.

FIG. 3 is a schematic diagram of change trends of the first current signal, the second current signal, and an average brightness of the LCD, in which the second discharge lamp 12 operates in operation mode. FIG. 4 is a schematic diagram of the change trends of the first current signal, second current signal, and the average brightness of the LCD, in which the second discharge lamp 12 operates in strike mode.

The dual-lamp driving circuit is initialized upon receipt of the first enable signal in both FIG. 3 and FIG. 4. At time t1, the dual-lamp driving circuit receives the second enable signal. The operation status of the first discharge lamp 11 changes from strike mode to the operation mode before the time t1. The second charge circuit 521 counts during time t1 and time t2. If the second discharge lamp 12 fails to be driven in operation mode during time t1 and time t2, the second discharge lamp 12 is driven in strike mode at time t3. The second discharge lamp 12 operates in operation mode when the second switch circuit 522 receives the second current signal.

Referring to FIG. 3, if the second discharge lamp 12 is driven in operation mode before time t2, the first current signal of the first discharge lamp 11 is normal, and the average brightness of the LCD is normal as well.

Referring to FIG. 4, if the second discharge lamp 12 fails to be driven in operation mode during time t1 to time t2, the second discharge lamp 12 is driven in strike mode at time t3. Here, the first discharge lamp 11 produces current interferences, and the average brightness of the LCD is abnormal in time t3.

The dual-lamp driving circuit of the disclosure is driven in operation mode first, and is driven in strike mode only when it fails to be driven in operation mode, so that abnormality of average brightness of the LCD is reduced.

In the disclosure, the frequency switch control circuit 50 and the PWM control circuit 40 respond to the first enable signal and the second enable signal, respectively, such that the first discharge lamp 11 and the second discharge lamp 12 are driven asynchronously, resulting in improved brightness and power efficiency. In addition, the driving mode of the second discharge lamp 12 is selectable according to the counting function of the feedback circuit 60 and the second charge circuit 512, resulting in expansion of the range of light adjustment, and brightness of the LCD is normalized.

It is believed that the exemplary embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A dual-lamp driving circuit for driving a first discharge lamp and a second discharge lamp, the dual-lamp driving circuit comprising:

a first frequency switch control circuit configured to receive a first enable signal, and output a first frequency switch signal based on the first enable signal;

a second frequency switch control circuit configured to receive a second enable signal, and output a second frequency switch signal based on the second enable signal;

a pulse-width modulation control circuit connected to the first frequency switch control circuit and the second frequency switch control circuit, and configured to output various pulse-width modulation control signals based on alternative one of the first frequency switch signal and the second frequency switch signal;

a first power stage circuit configured to receive and convert an external electrical signal into a first square-wave signal based on the pulse-width modulation control signal from the pulse-width modulation control circuit;

a second power stage circuit configured to receive the pulse-width modulation control signal under the direction of the second enable signal, and to receive and convert the external electrical signal into a second square-wave signal based on the received pulse-width modulation control signal;

a first conversion circuit connected between the first power stage circuit and the first discharge lamp, and configured to convert the first square-wave signal into a first sine wave signal able to drive the first discharge lamp;

a second conversion circuit connected between the second power stage circuit and the second discharge lamp, and configured to convert the second square-wave signal into a second sine wave signal able to drive the second discharge lamp; and a feedback circuit configured to feed back a first current signal through the first discharge lamp and a second current signal through the second discharge lamp to the first frequency switch control circuit and the second frequency switch control circuit respectively, so as to control the outputs of the first frequency switch control circuit and the second frequency switch control circuit.

2. The dual-lamp driving circuit of claim 1, wherein the first power stage circuit accepts the pulse-width modulation control signal from the pulse-width modulation control circuit upon receipt of the first enable signal.

3. The dual-lamp driving circuit of claim 1, wherein the first frequency switch control circuit comprises:

a first charge circuit configured to receive the first enable signal, and output the first frequency switch signal based on the first enable signal; and a first switch circuit configured to receive the first current signal from the feedback circuit, and stop the first charge circuit upon receipt of the first current signal.

4. The dual-lamp driving circuit of claim 3, wherein the first charge circuit comprises:

a first resistor with one end receiving the first enable signal; and a first capacitor with one end connected to the other end of the first resistor, and the other end connected to ground;

wherein when the first resistor receives the first enable signal, the first capacitor is charged and the first frequency switch signal is output from the other end of the first resistor.

5. The dual-lamp driving circuit of claim 4, wherein the first switch circuit comprises:

a second resistor with one end receiving the first current signal from the feedback circuit; and a first transistor with the base connected to the other end of the second resistor, the collector connected to the other end of the first resistor, and the emitter connected to ground;

wherein a voltage on the base of the first transistor rises sufficiently to turn on the first transistor when the first switch circuit receives the first current signal by way of the second resistor, the output of the first charge circuit is connected to ground via the first transistor, and the first charge circuit stops the first frequency switch signal to the pulse-width modulation control circuit.

6. The dual-lamp driving circuit of claim 5, wherein the first switch circuit further comprises a second capacitor with one end connected to the one end of the second resistor and the other end connected to ground.

7. The dual-lamp driving circuit of claim 3, wherein the second frequency switch control circuit comprises:

a second charge circuit configured to receive the second enable signal, and output the second frequency switch signal based on the second enable signal; and a second switch circuit configured to receive the second current signal from the feedback circuit, and determine whether the second charge circuit continues to output the second frequency switch signal based on the second current signal.

8. The dual-lamp driving circuit of claim 7, wherein the second charge circuit comprises:

a third resistor with one end receiving the second enable signal; and a third capacitor with one end connected to the other end of the third resistor, and the other end connected to ground;

wherein when the third resistor receives the second enable signal, the third capacitor is charged and the second frequency switch signal is output from the other end of the third resistor.

9. The dual-lamp driving circuit of claim 8, wherein the third resistor and the third capacitor are configured and structured to count a predetermined time upon receipt of the second enable signal so as to delay generation of the second frequency switch signal.

10. The dual-lamp driving circuit of claim 9, wherein if the second charge circuit counts over and the second switch circuit fails to receive the second current signal from the feedback circuit, the second frequency switch control circuit generates and transmits the second frequency switch signal to the pulse-width modulation control circuit.

11. The dual-lamp driving circuit of claim 8, wherein the second switch circuit comprises:

a fourth resistor with one end receiving the second current signal from the feedback circuit; and a second transistor with the base connected to the other end of the fourth resistor, the collector connected to the other end of the third resistor, and the emitter connected to ground;

wherein the second transistor turns on when the second switch circuit receives the second current signal by way of the fourth resistor, so that the output of the second charge circuit is connected to ground via the second transistor, and the second charge circuit stops outputting the second frequency switch signal to the pulse-width modulation control circuit.

12. The dual-lamp driving circuit of claim 11, wherein the second switch circuit further comprises a fourth capacitor with one end connected to the one end of the fourth resistor, and the other end connected to ground.

13. The dual-lamp driving circuit of claim 7, wherein the pulse-width modulation control circuit comprises:

a pulse-width modulation controller configured to generate the pulse-width modulation control signal;

a parallel circuit composed of a fifth resistor and a sixth resistor connected in parallel, wherein one end of the parallel circuit is connected to the pulse-width modulation controller, and the other end is grounded;

a third transistor with the base receiving the alternative one of the first frequency switch signal and the second frequency switch signal, the collector and the emitter are respectively connected to the five resistor and the ground, in series;

wherein when the base of the third transistor receives no first frequency switch signal or second frequency switch signal, the third transistor turns off and the fifth resistor is suspended, so that the impedance of the parallel circuit substantially equals that of the sixth resistor;

when the base of the third transistor receives alternative one of the first frequency switch signal and the second frequency switch signal, the third transistor turns on and the fifth resistor is coupled to the sixth resistor, so that the impedance of the parallel circuit is decreased.

14. The dual-lamp driving circuit of claim 13, wherein the pulse-width modulation controller comprises:

a lamp clock oscillator configured to output various frequencies based on different impedances of the parallel circuit; and a control logic unit configured to output the pulse-width modulation control signal to one or both of the first power stage circuit and the second power stage circuit based on the various frequencies output from the lamp clock oscillator.

15. The dual-lamp driving circuit of claim 1, further comprising a connection circuit connected between the first and second frequency switch control circuits and the pulse-width modulation control circuit, and configured to transmit one or both of the first and second frequency switch control signal to the pulse-width modulation control circuit.

16. The dual-lamp driving circuit of claim 15, wherein the connection circuit comprises:

a first diode with the anode connected to the first frequency switch control circuit;

a second diode with the anode connected to the second frequency switch control circuit, and the cathode connected to the cathode of the first diode; and a seventh resistor with one end connected to the cathodes of both the first diode and the second diode, and the other end connected to the pulse-width modulation control circuit;

wherein the first diode and the second diode are structured to avoid interference between the first frequency switch control circuit and the second frequency switch control circuit.

* * * * *